US006390341B1

(12) United States Patent
Ohmi et al.

(10) Patent No.: US 6,390,341 B1
(45) Date of Patent: May 21, 2002

(54) CONTAINER CLOSURE WITH OUTFLOW TUBE

(75) Inventors: Hidehiko Ohmi; Tateo Kubo; Mitsuo Kumata; Mituru Shionoya, all of Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 0 days.

(21) Appl. No.: 09/722,144

(22) Filed: Nov. 27, 2000

(30) Foreign Application Priority Data

Mar. 2, 2000 (JP) ..... 2000-057286
Jul. 14, 2000 (JP) ..... 2000-214815

(51) Int. Cl.[7] ..... B67D 3/00
(52) U.S. Cl. ..... 222/536; 222/538; 222/182
(58) Field of Search ..... 222/182, 533, 222/536, 556, 538; 215/235, 237, 245, 229, 387–389; 220/703, 705, 707, 708, 810, 836

(56) References Cited

U.S. PATENT DOCUMENTS 4,440,327 A * 4/1984 Dark ..... 222/530
4,485,963 A * 12/1984 Panicci ..... 222/531
5,078,289 A * 1/1992 Bolton et al. ..... 215/228
5,346,081 A * 9/1994 Lin ..... 222/530
5,884,793 A * 3/1999 Wang ..... 222/530
5,897,013 A * 4/1999 Manganiello ..... 220/252
5,908,126 A * 6/1999 Wang ..... 215/229
6,050,433 A * 4/2000 Russell et al. ..... 215/229

* cited by examiner

*Primary Examiner*—Joseph A. Kaufman
*Assistant Examiner*—Stephanie Willatt
(74) *Attorney, Agent, or Firm*—Antonelli, Terry, Stout & Kraus, LLP

(57) ABSTRACT

A container closure is composed of a closure body, an outflow tube, and an outer cap. The outflow tube is pivotably mounted on the closure body. The outer cap is mounted on the closure body pivotably between a closed position and an open position. When the outer cap is pivoted from the closed position toward the open position, the outer cap contacts the outflow tube located at the closed position to erect the outflow tube from the closed position to the outflow position. The outer cap is then separated from the outflow tube and brought to the open position. When the outer cap is pivoted from the open position toward the closed position, the outer cap contacts the outflow tube located at the outflow position to tilt the outflow tube from the outflow position to the closed position, and the outer cap is also brought to the closed position.

10 Claims, 9 Drawing Sheets

CONTAINER CLOSURE WITH OUTFLOW TUBE

FIELD OF THE INVENTION

This invention relates to a container closure to be applied to a mouth-and-neck portion of a container accommodating a liquid. More particularly, the invention relates to a container closure having an outflow tube for flowing out of the liquid contained in the container.

DESCRIPTION OF THE PRIOR ART

Each of Japanese Unexamined Utility Model Publication Nos. 60-96254 and 60-96255 discloses a container closure having a closure body to be mounted on a mouth-and-neck portion of a container, and an outflow tube mounted on the closure body. Such a container closure is to be applied to the mouth-and-neck portion of a container accommodating a liquid such as a beverage. The closure body has a circular main wall, and a cylindrical skirt wall extending downwardly from a peripheral edge of the main wall. The skirt wall is fitted on the outer peripheral surface of the mouth-and-neck portion of the container, and the main wall covers the top surface of the mouth-and-neck portion. In the main wall, an outflow hole is formed. The outflow tube is mounted on an upper surface of the main wall of the closure body pivotably between an erected outflow position and a toppled closed position. In the outflow tube, a penetrating outflow path is defined. When the outflow tube is erected at the outflow position, the penetrating outflow path of the outflow tube is made to communicate with the inside of the container via the outflow hole in the main wall of the closure body. Thus, one can drink the contents of the container, for example, by holding the outflow tube in one's mouth and sucking through it. When the outflow tube is toppled to the closed position, the penetrating outflow path is cut off from communication with the outflow hole.

The foregoing conventional container closure involves the following problems to be solved: First, the outflow tube is always exposed, making it unpreferred hygienically to hold the outflow tube in the mouth. Secondly, in the configuration disclosed in Japanese Unexamined Utility Model Publication No. 60-96254, there is need to hook a finger directly on the outflow tube in order to pivot the outflow tube. This is not preferred from the hygienic point of view. In the configuration disclosed in Japanese Unexamined Utility Model Publication No. 60-96255, the outflow tube can be pivoted by operating pivot means disposed on the main wall of the closure body. However, the container closure disclosed there is not necessarily easy to produce, because of the structure of the pivot means itself and a constitution concerned with the connection between the pivot means and the outflow tube.

The first problem can be solved by adding an outer cap which is fitted onto the closure body to cover the main wall of the closure body and the outflow tube located at the closed position. However, simply when the outer cap is added, it is necessary to move the outer cap to an open position relative to the closure body or remove the outer cap from the closure body, and further to erect the outflow tube from the closed position to the outflow position in order to flow out the contents of the container. After the outflow of the contents of the container is completed, it is necessary to topple the outflow tube from the outflow position to the closed position and to move the outer cap to the closed position relative to the closure body or to fit the outer cap onto the closure body. Thus, handling of the container closure is considerably tiresome.

SUMMARY OF THE INVENTION

A principal object of the present invention is to provide a novel and improved container closure, in which there is additionally an outer cap capable of covering a main wall of a closure body and an outflow tube situated at a closed position, and nevertheless, merely by opening or closing the outer cap, the outflow tube is pivoted as required, namely, erected or toppled, so that all of the aforementioned problems existing with the conventional container closure are solved.

Another object of the invention is to provide a novel and improved container closure, in which even if the outflow tube alone is toppled to the closed position when the outer cap is located at the open position, the outer cap is pivoted from the open position to the closed position sufficiently easily, whereby the outflow tube can be housed in the outer cap.

Still another object of the invention is to provide a novel and improved container closure in which the outer cap can be used as a measuring cup and a liquid contained in the container can be favorably measured and discharged.

The inventors of the invention conducted extensive studies, and found that the principal object could be attained in the following manner: An outflow tube is pivotably mounted on an upper surface of a main wall of a closure body. An outer cap is pivotably mounted on the closure body. The mounting positions and sizes of the outer cap and the outflow tube are suitably determined such that when the outer cap is pivoted from a closed position toward an open position, the outer cap interferes with the outflow tube located at a closed position to erect the outflow tube from the closed position to an outflow position, then the outer cap is separated from the outflow tube and brought to the open position, whereas when the outer cap is pivoted from the open position toward the closed position, the outer cap interferes with the outflow tube located at the outflow position to topple the outflow tube from the outflow position to the closed position, and the outer cap is also brought to the closed position.

That is, according to the present invention, as a container closure for attaining the principal object, there is provided a container closure comprising:

a closure body to be mounted on a mouth-and-neck portion of a container; an outflow tube having a penetrating outflow path; and an outer cap, and wherein:

the closure body has a main wall covering a top surface of the mouth-and-neck portion of the container, and an outflow hole is disposed in the main wall;

the outflow tube is pivotably mounted on an upper surface of the main wall of the closure body, when the outflow tube is located at an outflow position at which the outflow tube extends upward from the outflow hole of the main wall, the penetrating outflow path is made to communicate with an interior of the container via the outflow hole, and when the outflow tube is toppled to a closed position, the penetrating outflow path is cut off from communication with the outflow hole;

the outer cap is mounted on the closure body pivotably between a closed position and an open position, when at the closed position, the outer cap covers the main wall of the closure body and the outflow tube, and when at the open position, the outer cap exposes the main wall of the closure body and the outflow tube;

when the outer cap is pivoted from the closed position toward the open position, the outer cap interferes withthe outflow tube located at the closed position to erect the outflow tube from the closed position to the outflow position, then the outer cap is separated from the outflow tube and brought to the open position, and when the outer cap is pivoted from the open position toward the closed position, the outer cap interferes with the outflow tube located at the outflow position to topple the outflow tube from the outflow position to the closed position, and the outer cap is also brought to the closed position.

In the container closure for attaining another object of the invention, a closed position restricting piece, which is tilted when a pressing force of a predetermined value or more is exerted, may be disposed on the main wall of the closure body; when a pressing force of a predetermined value or more is exerted on the closed position restricting piece via the outflow tube after the outflow tube is toppled and contacted with the closed position restricting piece, the closed position restricting piece may be tilted and the outflow tube may be further toppled; and when the pressing force via the outflow tube is released, the closed position restricting piece may be elastically restored. Preferably, the closed position restricting piece has a thin-walled lower end portion, and is tilted by being pivoted about the thin-walled lower end portion as a pivot center.

In the container closure for attaining still another object of the invention, a metering mark may be disposed on the outer cap. The outer cap is preferably transparent or semitransparent.

The invention also has the following preferred embodiments: A pivot center axis of the outflow tube and a pivot center axis of the outer cap extend substantially parallel, and the pivot center axis of the outer cap is positioned below, and radially outwardly of, the pivot center axis of the outflow tube. The outer cap has a circular top panel wall, and a cylindrical skirt wall extending downwardly from a peripheral edge of the top panel wall. When the outer cap is pivoted from the closed position toward the open position, an inner peripheral surface of a lower end portion of the skirt wall interferes with a front end portion of the outflow tube, and when the outer cap is pivoted from the open position toward the closed position, a lower end or the inner peripheral surface of the lower end portion of the skirt wall interferes with the front end portion of the outflow tube. A grip protrusion protruding radially outwardly is disposed at a position in an upper end portion of an outer peripheral surface of the skirt wall of the outer cap, the position being farthermost from a pivot center axis of the outer cap.

DETAILED DESCRIPTION OF THE PREFERRED EMBODIMENTS

A container closure constituted in accordance with the present invention will now be described in further detail with reference to the accompanying drawings showing preferred embodiments of the invention.

Figure 1:
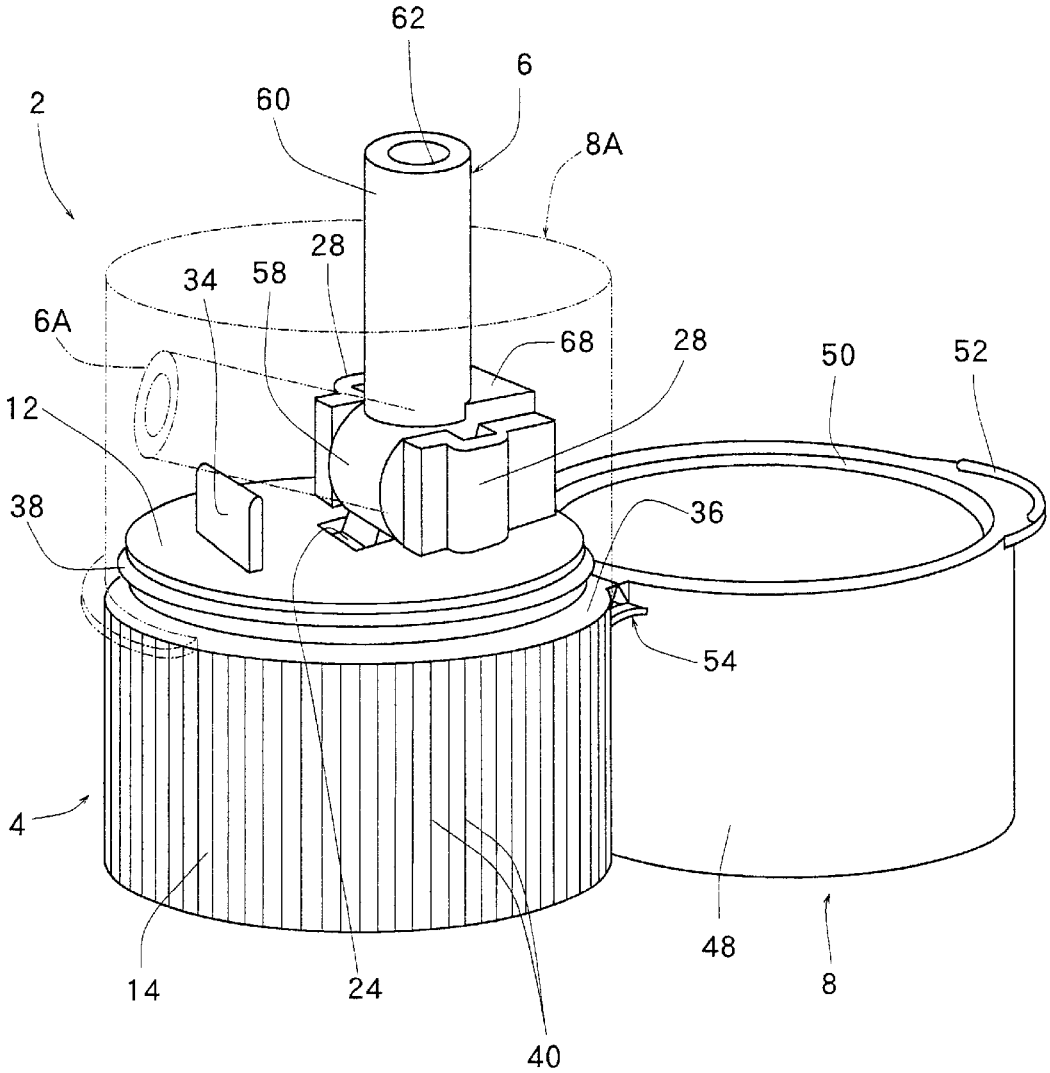
FIG. 1 is a perspective view showing a preferred embodiment of a container closure constituted in accordance with the present invention.
Figure 2:
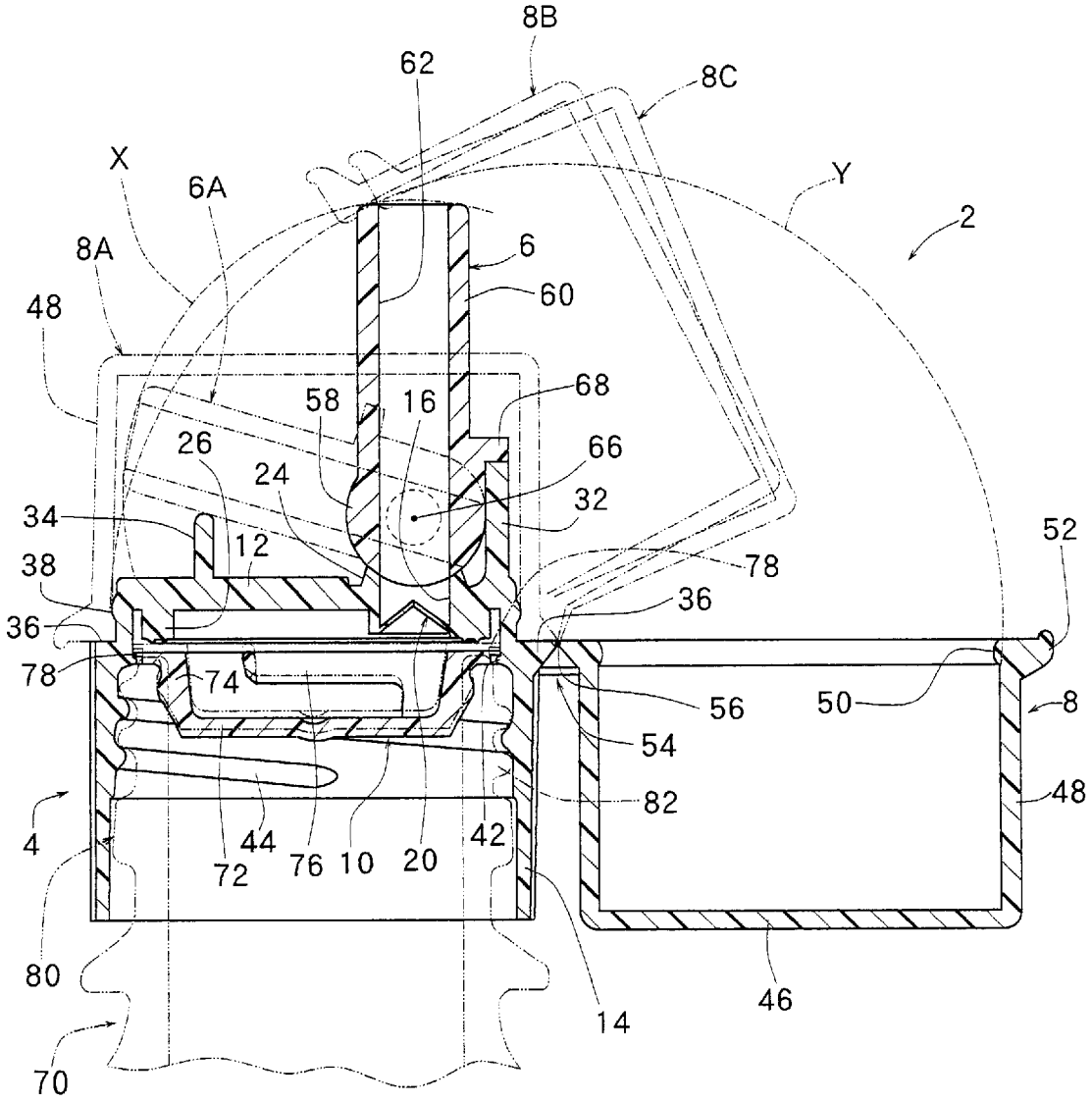
FIG. 2 is a vertical sectional view of the container closure shown in FIG. 1.
Figure 3:
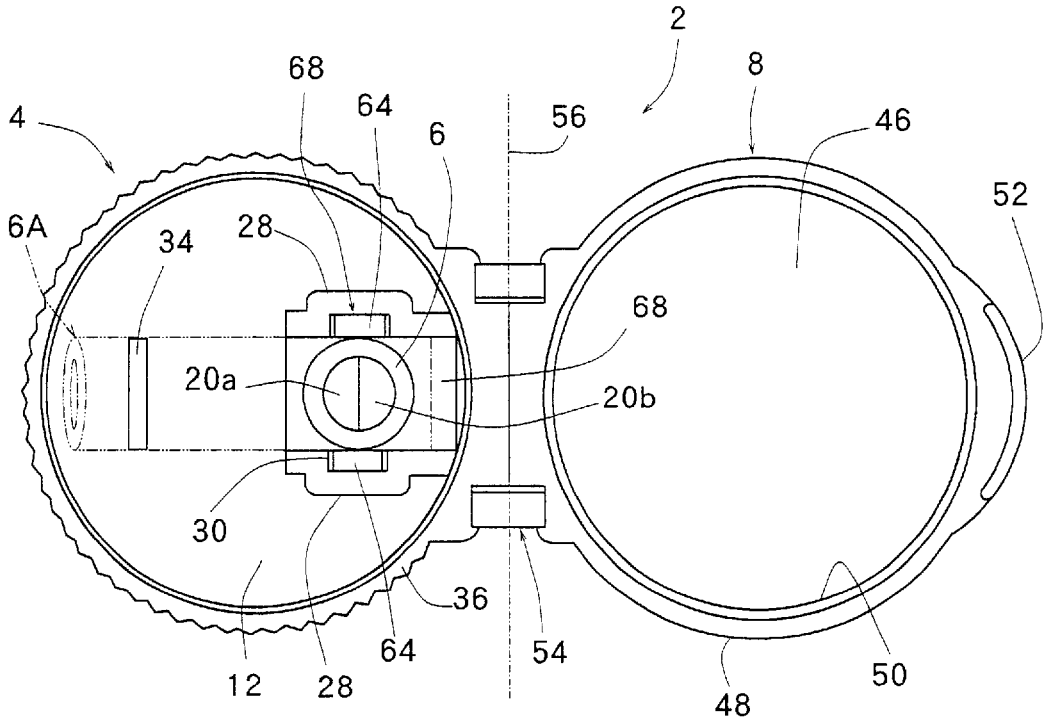
FIG. 3 is a plan view of the container closure shown in FIG. 1.

With reference to FIGS. 1 to 3 showing preferred embodiments of the container closure, the illustrated container closure designated entirely as the numeral 2 is composed of a closure body 4, an outflow tube 6, an outer cap 8, and an internal stopper 10. The closure body 4 and the outer cap 8 are integrally molded from a suitable plastic material, such as polypropylene or polyethylene. The outflow tube 6 and the internal stopper 10 are separately and individually molded from a suitable plastic material, such as polypropylene or polyethylene.

Figure 4:
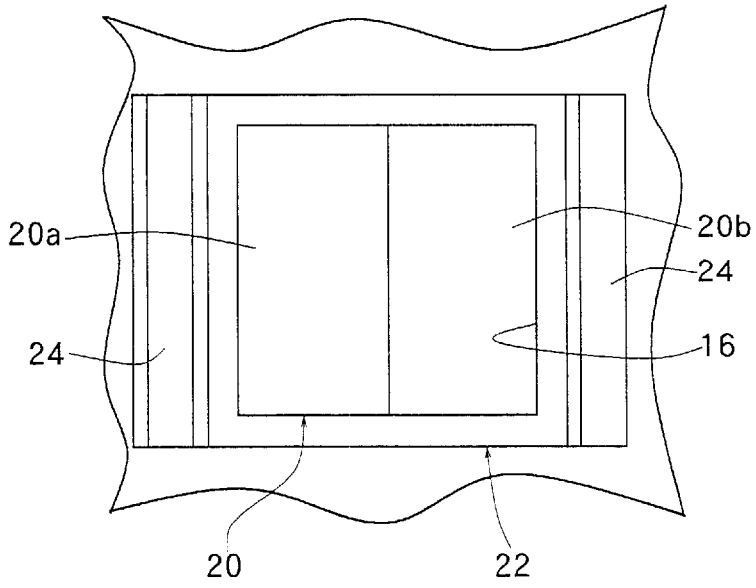
FIG. 4 is a partial plan view showing a check valve of the container closure shown in FIG. 1.
Figure 5:
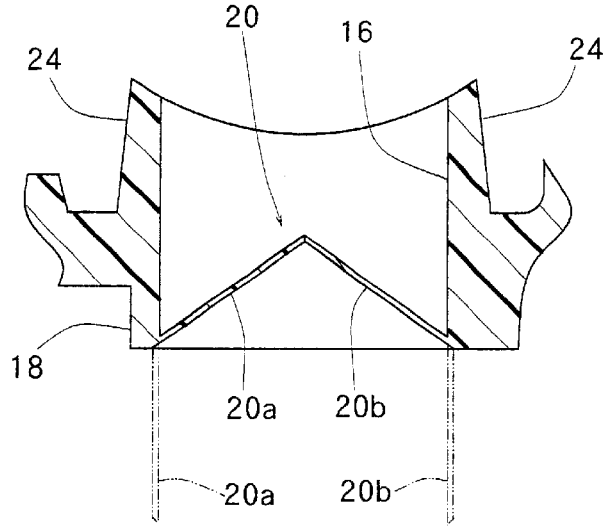
FIG. 5 is a partial sectional view showing the check valve of the container closure shown in FIG. 1.

Further referring to FIGS. 1 to 3, the container closure 4 in the illustrated embodiment has a circular main wall 12 extending substantially horizontally, and a cylindrical skirt wall 14 extending downwardly from the peripheral edge of the main wall 12. In the main wall 12, an outflow hole 16 is formed at a position displaced slightly rightwardly (in FIG. 2) from the center of the main wall 12. As will be clearly understood by reference to FIGS. 4 and 5, the outflow hole 16 in the illustrated embodiment is square in cross sectional shape. A square crate portion 18 extending downwardly from the peripheral edge of the outflow hole 16 is formed on a lower surface of the main wall 12. A check valve 20 is disposed at the lower end of the square crate portion. The check valve 20 can be formed favorably by forming two thin-walled pieces 20*a* and 20*b*, which extend downwardly from two opposed side edges of the square crate portion, during injection molding of the closure body 4 as shown by two-dot chain lines in FIG. 5, and then forcibly folding back the two thin-walled pieces 20*a* and 20*b* upwardly into a state indicated by solid lines. On the upper surface of the main wall 12, a seat portion 22 is formed which protrudes upward from the peripheral edge of the outflow hole 16. The seat portion 22 is arcuate in a section shown in FIG. 2, and has bearing surfaces extending in a direction perpendicular to the sheet face in FIG. 2, and extending linearly in an up-and-down direction in FIG. 3. Grooves 24 are formed on both sides of the seat portion 22.

Figure 6:
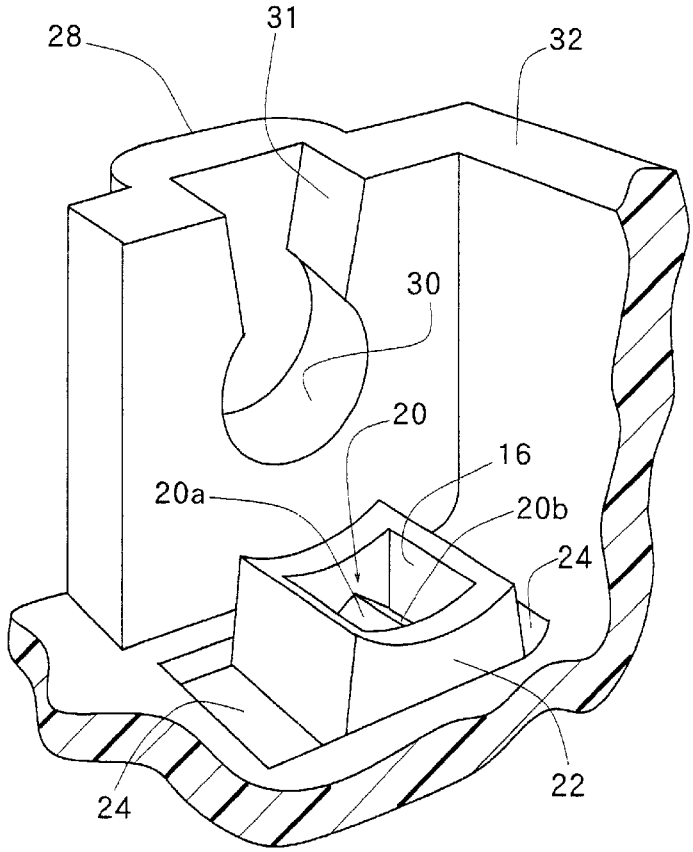
FIG. 6 is a partial perspective view showing an inner surface of a mounting wall of the container closure shown in FIG. 1.

As will be understood by reference to FIG. 2, an annular downward-extending wall 26 is formed in a lower surface peripheral edge portion of the main wall 12. On a lower surface of the downward-extending wall 26, two sealing projections are formed. On an upper surface of the main wall 12, a pair of mounting walls 28 extending substantially vertically upwardly (in an up-and-down direction in FIG. 3) are formed, as shown in FIGS. 1 and 3. In an inner surface of each of the mounting walls 28, a circular bearing depression 30 is formed, as shown in FIG. 6. In the inner surface of each of the mounting walls 28, an inverted triangular guide depression 31 is also formed which opens the top of the bearing depression 30 upwardly. On the upper surface of the main wall 12, there are further formed an outflow position restricting piece 32 for defining the outflow position of the outflow tube 6, and a closed position restricting piece 34 for restricting the closed position of the outflow tube 6. The outflow position restricting piece 32 is disposed between the rear ends (right ends in FIG. 3) of the mounting walls 28. The closed position restricting piece 34 is disposed apart leftwardly from the mounting walls 28 in FIG. 3. The outflow position restricting piece 32 and the closed position restricting piece 34 are each in the shape of a substantially vertically protruding flat plate, and extend parallel to each other.

An annular shoulder surface 36 directed upward is formed in an upper portion of the outer peripheral surface of the skirt wall 14 of the closure body 4. Above the annular shoulder surface 36, an annular engaging projection 38 is formed on the outer peripheral surface of the skirt wall 14. Below the annular shoulder surface 36 on the outer peripheral surface of the skirt wall 14, projections and depressions axially extending, i.e., knurls, 40 are formed. In an upper portion of an inner peripheral surface of the skirt wall 14, an annular holding projection 42 is formed. In an intermediate portion of the inner peripheral surface of the skirt wall 14, an internal thread 44 is formed.

The outer cap 8 molded integrally with the closure body 4 has a circular top panel wall 46, and a cylindrical skirt wall 48 extending downwardly from the peripheral edge of the top panel wall 46. An annular engaging projection 50 is formed at the lower end of an inner peripheral surface of the skirt wall 48. A grip protrusion 52 is formed at a specific angular site at the lower end of an outer peripheral surface of the skirt wall 48. As will be clearly understood by reference to FIG. 3, the outer cap 8 is connected integrally to the closure body 4 via hinge coupling means 54. The hinge coupling means 54 is disposed between a specific angular site at the lower end of the outer peripheral surface of the skirt wall 48 in the outer cap 8 (the site at a position diametrically opposite to the grip protrusion 52) and a specific angular site of the annular shoulder surface 36 of the skirt wall 14 in the closure body 4. The hinge coupling means 54 connects the outer cap 8 to the closure body 4 such that the outer cap 8 is pivotable about a pivot center axis 56 between a closed position indicated by two-dot chain lines 8A in FIGS. 1 and 2 and an open position indicated by solid lines in FIGS. 1 to 3. The illustrated hinge coupling means 54 of a shape well known among people skilled in the art elastically urges the outer cap 8 to the open position when the outer cap 8 is pivoted from the closed position toward the open position beyond a required angle, and elastically urges the outer cap 8 to the closed position when the outer cap 8 is pivoted from the open position toward the closed position beyond a required angle. When the outer cap 8 is brought to the closed position indicated by the two-dot chain lines 8A in FIGS. 1 and 2, the annular engaging projection 50 formed on the inner peripheral surface of the skirt wall 48 of the outer cap 8 elastically passes over the annular engaging projection 38 formed on the outer peripheral surface of the skirt wall 14 of the closure body 4, and engages a portion below the annular engaging projection 38, thereby maintaining the outer cap 8 at the closed position.

Further referring to FIGS. 1 to 3, the outflow tube 6 has a base 58 and an extension 60. As shown clearly in FIG. 2, a penetrating outflow path 62 extending through the base 58 and the extension 60 is formed in the outflow tube 6. The cross sectional shape of the penetrating outflow path 62 may be circular. The exterior shape of the base 58 may be a nearly cylindrical shape extending in a direction perpendicular to the sheet face in FIG. 2. The exterior shape of the extension 60 may be a cylindrical shape extending substantially perpendicularly to the base 58. The exterior shape of the base 58 matches the shape of the upper surface of the seat portion 22 formed in the main wall 12 of the closure body 4. On the end surfaces of the base 58, cylindrical shaft portions 64 are formed. The outflow tube 6 of this configuration is mounted on the closure body 4, pivotably between a closed position indicated by two-dot chain lines 6A in FIGS. 1 to 3 and an outflow position indicated by solid lines in FIGS. 1 to 3, by forcibly inserting the base 64 via the guide depressions 31 into the bearing depressions 30 formed in the pair of mounting walls 28 formed on the main wall 12 of the closure body 4. The outflow tube 6 is pivoted about the central axis of the shaft portions 64 (and the bearing depressions 30) as a pivot center axis 66. At the boundary between the base 58 and the extension 60 of the outflow tube 6, a plate-like protrusion 68 is formed which protrudes rightward in FIG. 2 in a state in which the outflow tube 6 is located at the outflow position. When the outflow tube 6 is pivoted from the outflow position to the closed position, a lower surface of the extension 60 of the outflow tube 6 is brought into contact with the closed position restricting piece 34 formed on the main wall 12 of the closure body 4. Thus, the outflow tube 6 is prevented from being further pivoted counterclockwise in FIG. 2 beyond the closed position. When the outflow tube 6 is pivoted from the closed position to the outflow position, the plate-like protrusion 68 of the outflow tube 6 contacts an upper surface of the outflow position restricting piece 32.formed on the main wall 12 of the closure body 4. Thus, the outflow tube 6 is prevented from being further pivoted clockwise in FIG. 2 beyond the outflow position. As will be clearly understood by referring to FIG. 2, when the outflow tube 6 is brought to the outflow position, the penetrating outflow path 62 formed in the outflow tube 6 is directly connected to the outflow hole 16 formed in the main wall 12 of the closure body 4. When the outflow tube 6 is put to the closed position indicated by the two-dot chain lines 6A, the penetrating outflow path 62 of the outflow tube 6 is separated from the outflow hole 16. Simultaneously, the outer surface of the outflow tube 6 in contact with the seat portion 22 disposed around the outflow hole 16 closes the outflow hole 16.

With reference to FIG. 2, in the illustrated embodiment, the outflow tube 6 is pivoted about the pivot center axis 66. During this pivoting, the front end of the outflow tube 6 draws a locus X indicated by a one-dot chain line. On the other hand, the outer cap 8 is pivoted about the pivot center axis 56. During this pivoting motion, the farthest point from the pivot center axis 56, at the lower end of the inner peripheral surface of the skirt wall 48, give a locus Y indicated by a one-dot chain line. As will be clearly understood from FIG. 2, the pivot center axis 66 and the pivot center axis 56 are parallel to each other, and the pivot center axis 56 is located below, and radially outwardly of, the pivot center axis 66. As will be seen from a comparison between the locus X and the locus Y shown in FIG. 2, when the outer cap 8 is pivoted from the closed position toward the open position, the inner peripheral surface of the lower end portion of the skirt wall 48 of the outer cap 8 contacts and interferes with the front end portion of the outflow tube 6. Thus, the outflow tube 6 is also pivoted from the closed position toward the outflow position in accordance with the pivot of the outer cap 8. When the outer cap 8 is pivoted to a position indicated by two-dot chain lines 8B and the outflow tube 6 is pivoted to the outflow position shown by the solid lines, the plate-like protrusion 68 of the outflow tube 6 contacts the upper surface of the outflow position restricting piece 32 formed on the main wall 12 of the closure body 4. As a result, the outflow tube 6 is inhibited from being further pivoted clockwise in FIG. 2. Thus, after this state, the outer cap 8 is separated from the outflow tube 6, and pivoted toward the open position, with the outflow tube 6 being left behind at the outflow position.

During motion of the outer cap 8 from the open position toward the closed position, when the outer cap 8 is pivoted to a position indicated by two-dot chain lines 8C in FIG. 2, the skirt wall 48 of the outer cap 8 covers at least most of the outflow tube 6 (in other words, at least most of the outflow tube 6 is accommodated into the skirt wall 48 of the outer cap 8), and the lower end or the inner peripheral surface lower end portion of the skirt wall 48 of the outer cap 8 contacts the left edge (in FIG. 2) of the front end of the outflow tube 6. Thus, when the outer cap 8 is further pivoted, the outflow tube 6 is also pivoted accordingly from the outflow position toward the closed position shown by the two-dot chain lines 6A. When the outflow tube 6 is pivoted to the closed position shown by the two-dot chain lines 6A, the lower surface of the extension 60 of the outflow tube 6 is brought into contact with the closed position restricting piece 34 formed on the main wall 12 of the closure body 4. As a result, the outflow tube 6 is restrained from being further pivoted counterclockwise in FIG. 2. Thus, after this state, the outer cap 8 is pivoted to the closed position, with the outflow tube 6 being left at the closed position.

The locus X of the front end of the outflow tube 6, and the locus Y of the farthest point from the pivot center axis 56 that lies at the lower end of the inner peripheral surface of the skirt wall 48 of the outer cap 8 are preferably set so as to intersect slightly upstream from the closed position of the outflow tube 6 and slightly upstream from the outflow position of the outflow tube 6, in the direction of pivoting of the outflow tube 6 from the closed position to the outflow position, as shown clearly in FIG. 2. If they are set in this manner, when the outer cap 8 is pivotally moved from the closed position shown by the two-dot chain lines 8A in FIG. 2 toward the open position shown by the solid lines in FIG. 2, the outer cap 8 and/or the outflow tube 6 are/is slightly elastically deformed, and the outer cap 8 is separated from the outflow tube 6, during pivoting of the outer cap 8 from the position shown by the two-dot chain lines 8B in FIG. 2 to the position shown by the two-dot chain lines 8C in FIG. 2. When the outer cap 8 is pivotally moved from the open position shown by the solid lines in FIG. 2 toward the closed position shown by the two-dot chain lines 8A in FIG. 2, the outer cap 8 and/or the outflow tube 6 are/is slightly elastically deformed, and the outer cap 8 is separated from the outflow tube 6, after pivoting of the outflow tube 6 to the closed position shown by the two-dot chain lines 6A in FIG. 2 in accordance with pivoting of the outer cap 8.

Referring to FIG. 2, before the container closure 2 is applied to a container 70, the internal stopper 10 is combined with the closure body 4. The internal stopper 10 includes a circular bottom wall 72, and a cylindrical side surface wall 74 extending upwardly from the peripheral edge of the circular bottom wall 72. A pull ring 76 is connected to an inner peripheral surface of the side surface wall 74. A thin-walled flange 78 protruding radially outwardly is formed in an upper end portion of an outer peripheral surface of the side surface wall 74. Such an internal stopper 10 is held in the closure body 4 relatively weakly, in other words so as to be easily removed with a small force, by elastically engaging the thin-walled flange 78 with the annular holding projection 42 formed in the upper portion of the inner peripheral surface of the skirt wall 14 in the closure body 4.

With reference to FIG. 2, the container closure 2 having the internal stopper 10 combined therewith and the outer cap 8 located at the closed position is mounted on a mouth-and-neck portion 80 of the container 70 which may be formed from a suitable plastic material such as polyethylene terephthalate. The mouth-and-neck portion 80 of the container 70 is nearly cylindrical, and has an external thread 82 formed on an outer peripheral surface thereof. The container closure 2 is mounted on the mouth-and-neck portion 80 by fitting the closure body 4 over the mouth-and-neck portion 80, and turning it in a closing direction, namely, clockwise when viewed from above in FIG. 2. When the internal thread 44 formed on the inner peripheral surface of the skirt wall 14 of the closure body 4 is screwed to the external thread 82 of the mouth-and-neck portion 80, the internal stopper 10 combined with the closure body 4 has the bottom wall 72 and the side surface wall 74 inserted into the mouth-and-neck portion 80, and has the thin-walled flange 78 contacted with the top surface of the mouth-and-neck portion 80. Upon contact of the thin-walled flange 78 with the top surface of the mouth-and-neck portion 80, the internal stopper 10 is slightly lifted relative to the closure body 4, as shown by two-dot chain lines in FIG. 2. As a result, the thin-walled flange 78 is held between the downward-extending wall 26 of the closure body 4 and the top surface of the mouth-and-neck portion 80. If desired, a tamper evident bottom portion of a suitable shape may be provided on the skirt wall 14 of the closure body 4, or the entire container closure 2 may be covered with a shrink film, in order to impart tamper evident properties.

To drink the contents of the container 70, for example a liquid beverage, fingers are applied to the knurls 40 of the skirt wall 14 of the closure body 4 to turn the outer cap 8 in the opening direction, i.e., counterclockwise when viewed from above in FIG. 2. By so doing, the internal thread 44 of the closure body 4 is moved along the external thread 82 of the mouth-and-neck portion 80. Thus, the closure body 4 (accordingly, the outer cap 8, outflow tube 6) is hoisted in accordance with he turning. Whereas the internal stopper 10 alone is combined with the closure body 4 easily removably by a small force, as stated earlier. Hence, the internal stopper 10 is removed from the closure body 4 and left behind on the mouth-and-neck portion 80. Then, a finger is hooked on the pull ring 76 to remove the internal stopper 10 from the mouth-and-neck portion 80, thereby unsealing the mouth-and-neck portion 80. Then, the container closure 2 is mounted again on the mouth-and-neck portion 80 from which the internal stopper 10 has been removed. That is, the closure body 4 is fitted on the mouth-and-neck portion 80, and turned in the closing direction to screw the internal thread 44 formed on the skirt wall 14 of the closure body 4 onto the external thread 82 of the mouth-and-neck portion 80. By this measure, the annular downward-extending wall 26 formed on the lower surface of the main wall 12 of the closure body 4 is contacted with the top surface of the mouth-and-neck portion 80, whereby the mouth-and-neck portion 80 is sealed. Then, the outer cap 8 is pivoted about the pivot center axis 56 toward the open position shown by the solid lines in FIGS. 1 and 2. The inner peripheral surface of the lower end portion of the skirt wall 48 of the outer cap 8 interferes with the front end portion of the outflow tube 6. In accordance with the pivot of the outer cap 8, the outflow tube 6 is also pivoted from the closed position toward the outflow position. When the outer cap 8 is pivoted to the position shown by the two-dot chain lines 8B, the outflow tube 6 is pivoted to the outflow position shown by the solid lines. As a result, the plate-like protrusion 68 of the outflow tube 6 contacts the upper surface of the outflow position restricting piece 32, and also the base 58 of the outflow tube 6 contacts the front surface of the outflow position restricting piece 32. Consequently, the outflow tube 6 is inhibited from being further pivoted clockwise in FIG. 2. When the outer cap 8 is further pivoted clockwise from the position shown by the two-dot chain lines 8B, and the outer cap 8 is separated from the outflow tube 6 and pivoted to the open position, with the outflow tube 6 being left at the outflow position. The outflow tube 6, when located at the outflow position extends upward from the outflow hole 16 of the main wall 12, so that the penetrating outflow path 62 communicates with the interior of the container 70 via the outflow hole 16. Thus, when one holds the front end portion of the outflow tube 6 in one's mouth and sucks, the portion downstream from, i.e. above, the check valve 20 becomes negative in pressure. As a result, the thin-walled pieces 20*a* and 20*b* of the check valve 20 are bent upward in FIG. 2 to release the check valve 20. Thus, the contents accommodated in the container 70 are discharged through the outflow hole 16 and the penetrating outflow path 62. If desired, the main portion of the container 70 may be slightly crushed to promote discharge of the contents from the container 70. After a required amount of the beverage is drunk, suction through the outflow tube 6 or crushing of the main portion of the container is stopped. At this time, the two thin-walled pieces 20*a* and 20*b* of the check valve 20 are restored downward in FIG. 2 by their own elastic force to close the check valve 20. Then, the outer cap 8 is pivoted about the pivot center axis 56 toward the closed position shown in FIGS. 1 and 2. When the outer cap 8 is pivoted to the position shown by the two-dot chain lines 8C in FIG. 2, the lower surface or the inner peripheral surface lower end of the skirt wall 48 of the outer cap 8 contacts the front end of the outflow tube 6. When the outer cap 8 is further pivoted, the outflow tube 6 is also pivoted accordingly from the outflow position toward the closed position shown by the two-dot chain lines 6A. When the outflow tube 6 is pivoted to the closed position shown by the two-dot chain lines 6A in FIGS. 1 and 2, the lower surface of the extension 60 of the outflow tube 6 is brought into contact with the closed position restricting piece 34 formed on the main wall 12 of the closure body 4. This prevents further counterclockwise pivoting of the outflow tube 6. When the outflow tube 6 is pivoted to the closed position shown by the two-dot chain lines 6A, the penetrating outflow path 62 of the outflow tube 6 is separated from the outflow hole 16, and the outer surface of the outflow tube 6 in contact with the seat portion 22 disposed around the outflow hole 16 closes the outflow hole 16. Thus, leakage of the contents through the outflow tube 6 is prevented, and the contents are sealed up fully reliably. The outer cap 8 is further pivoted to the closed position shown by the two-dot chain lines 8A in FIG. 2.

Figure 7:
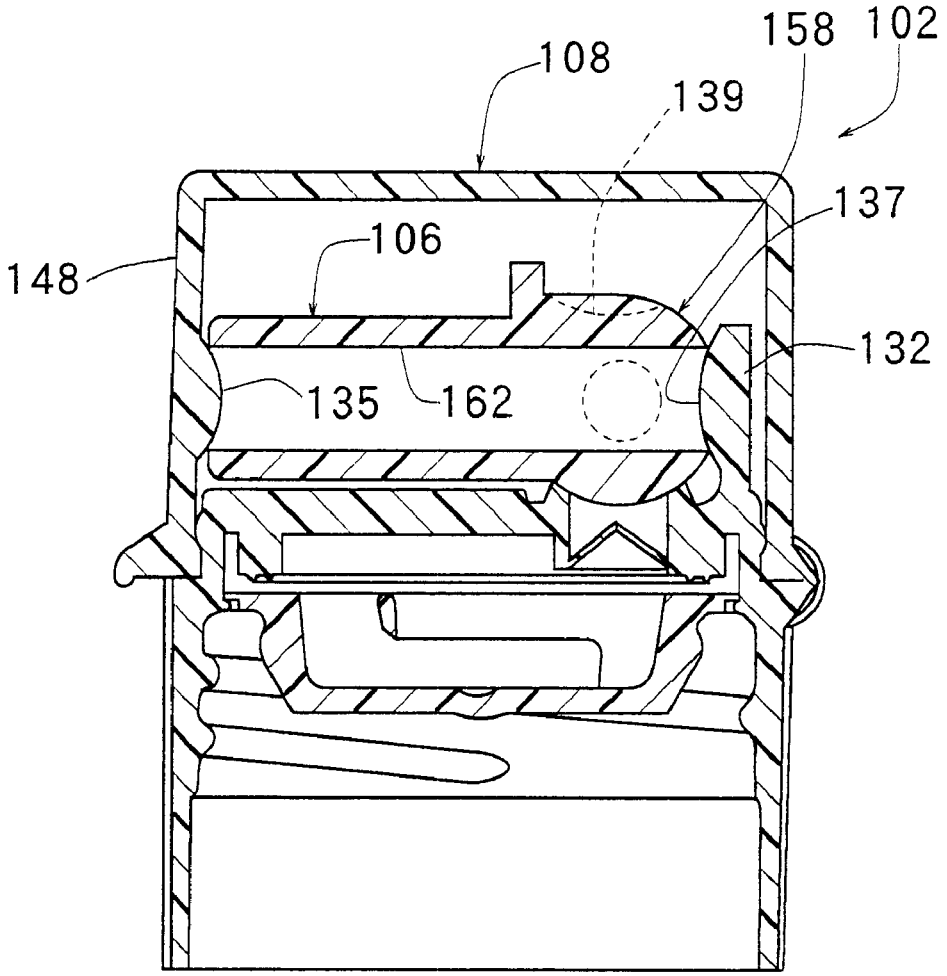
FIG. 7 is a vertical sectional view showing a modified embodiment of a container closure constituted in accordance with the present invention.

FIG. 7 shows a modified embodiment of a container closure constituted in accordance with the present invention. In a container closure 102 shown in FIG. 7, a convex protrusion 135 is formed at a specific angular site on the inner peripheral surface of a cylindrical skirt wall 148 of an outer cap 108. When the outer cap 108 is located at a closed position, the convex protrusion 135 is in intimate contact with the front end of an outflow tube 106, whereby the downstream end of a penetrating outflow path 162 of the outflow tube 106 is closed. Since the convex protrusion 135 is in intimate contact with the front end of the outflow tube 106, the outflow tube 106 is maintained at the illustrated closed position. In the modified embodiment shown in FIG. 7, therefore, a closed position restricting piece (the closed position restricting piece 34 in FIGS. 1 to 3) is not required. In the modified embodiment shown in FIG. 7, moreover, a convex protrusion 137 is formed on the inner surface of an outflow position restricting piece 132. When the outflow tube 106 is brought to the closed position, the convex protrusion 137 is intimately contacted with the base end of the outflow tube 106, so that the upstream end of the penetrating outflow path 162 of the outflow tube 106 is also closed. In correspondence with the formation of the convex protrusion 137 on the inside of the outflow position restricting piece 132, a concave recess 139 is formed at a required position of the base 158 of the outflow tube 106 (i.e., an upper surface of the outflow tube 106 when situated at the closed position). When the outflow tube 106 is pivoted to the outflow position at which it extends substantially vertically upwardly, the convex protrusion 137 is accepted by the concave recess 139. The modified embodiment shown in FIG. 7 is substantially the same as the embodiment shown in FIGS. 1 to 6, except for the constitution described above.

FIGS. 8 to 11 show another preferred embodiment of a container closure constituted in accordance with the present invention. In a container closure 202 shown in FIGS. 8 to 11, a closed position restricting piece 234 formed on a main wall 212 of a closure body 204 extends slantwise upwardly rearwardly (i.e., rightwardly in FIG. 9) from an upper surface of the main wall 212. If desired, the closed position restricting piece 234 can be inclined upwardly forward (i.e., leftward in FIG. 9). The closed position restricting piece 234 is in the shape of a flat plate as a whole, but has a thin-walled lower end portion 235 extending throughout the width of its lower end. As will be further mentioned later on, when a pressing force of a predetermined value or more is exerted on the upper edge of the closed position restricting piece 234, the closed position restricting piece 234 is tilted clockwise in FIG. 9 about the thin-walled lower end portion 235, as shown by two-dot chain lines 234A in FIG. 9. When the pressing force is released, the closed position restricting piece 234 is restored to a state shown by solid lines in FIG. 9. Furthermore, mounting walls 228 formed on the upper surface of the main wall 212 in the embodiment shown in FIGS. 8 to 11 are slightly different in shape from the mounting walls 28 formed on the upper surface of the main wall 12 in the embodiment shown in FIGS. 1 to 6, and have a flat outer surface. The container closure 202 in the embodiment shown in FIGS. 8 to 11 is substantially the same as the container closure 2 in the embodiment shown in FIGS. 1 to 6, except for the above-described constitution.

In an outer cap 208 in the embodiment shown in FIGS. 8 to 11, a grip protrusion 252 formed on an outer peripheral surface of a skirt wall 248 is protruded radially outwardly not from a lower end of the outer peripheral surface of the skirt wall 248, but from an upper end of the outer peripheral surface of the skirt wall 248. At an angular position of formation of the grip protrusion 252, i.e., an angular position diametrically opposite to the angular position of placement of hinge coupling means 254 between the closure body 204 and the outer cap 208, a depressed portion 253 of a slightly smaller outer diameter than other portions is formed on the outer peripheral surface of the skirt wall 248.

Figure 8:
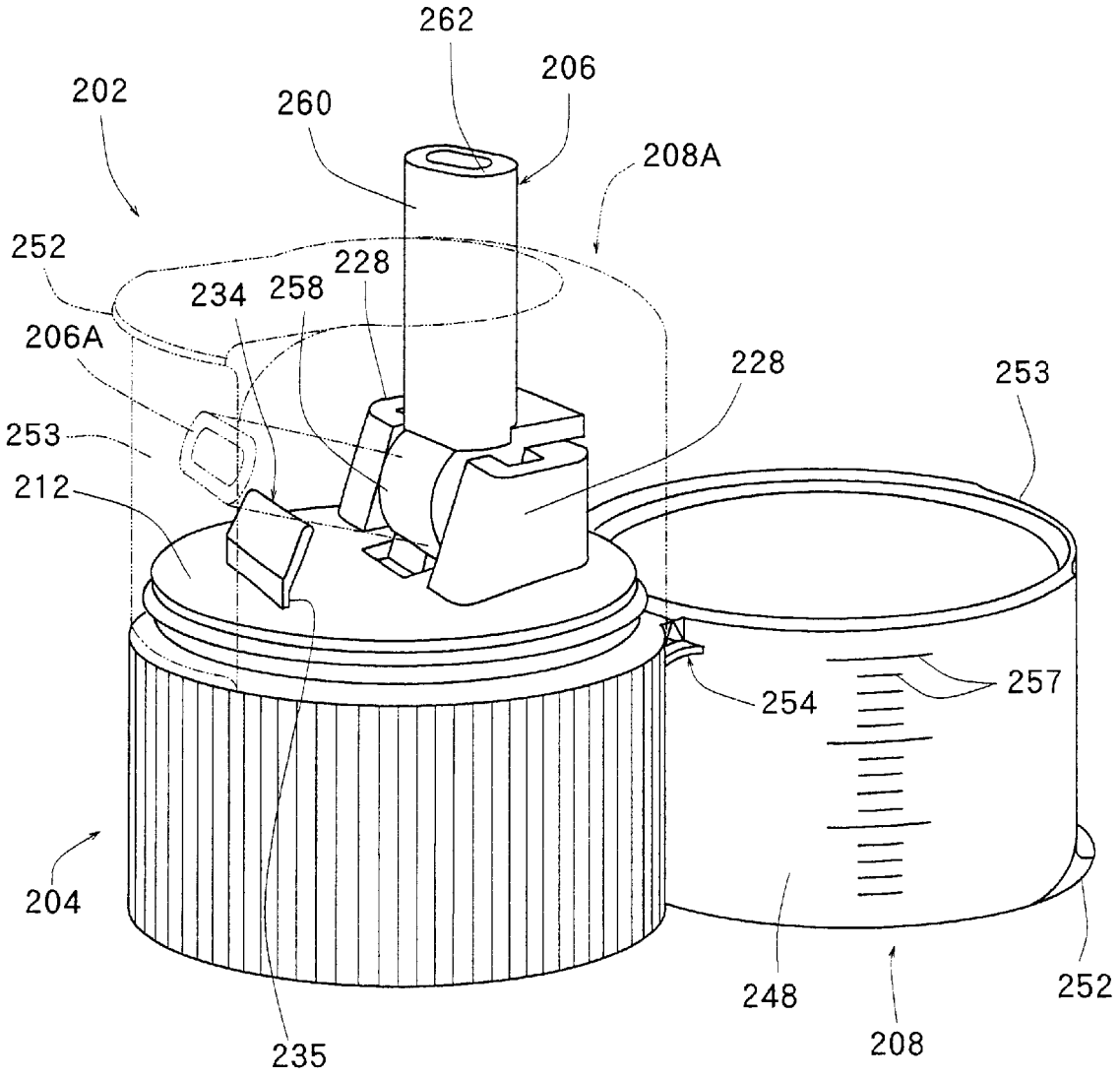
FIG. 8 is a perspective view showing another preferred embodiment of a container closure constituted in accordance with the present invention.
Figure 9:
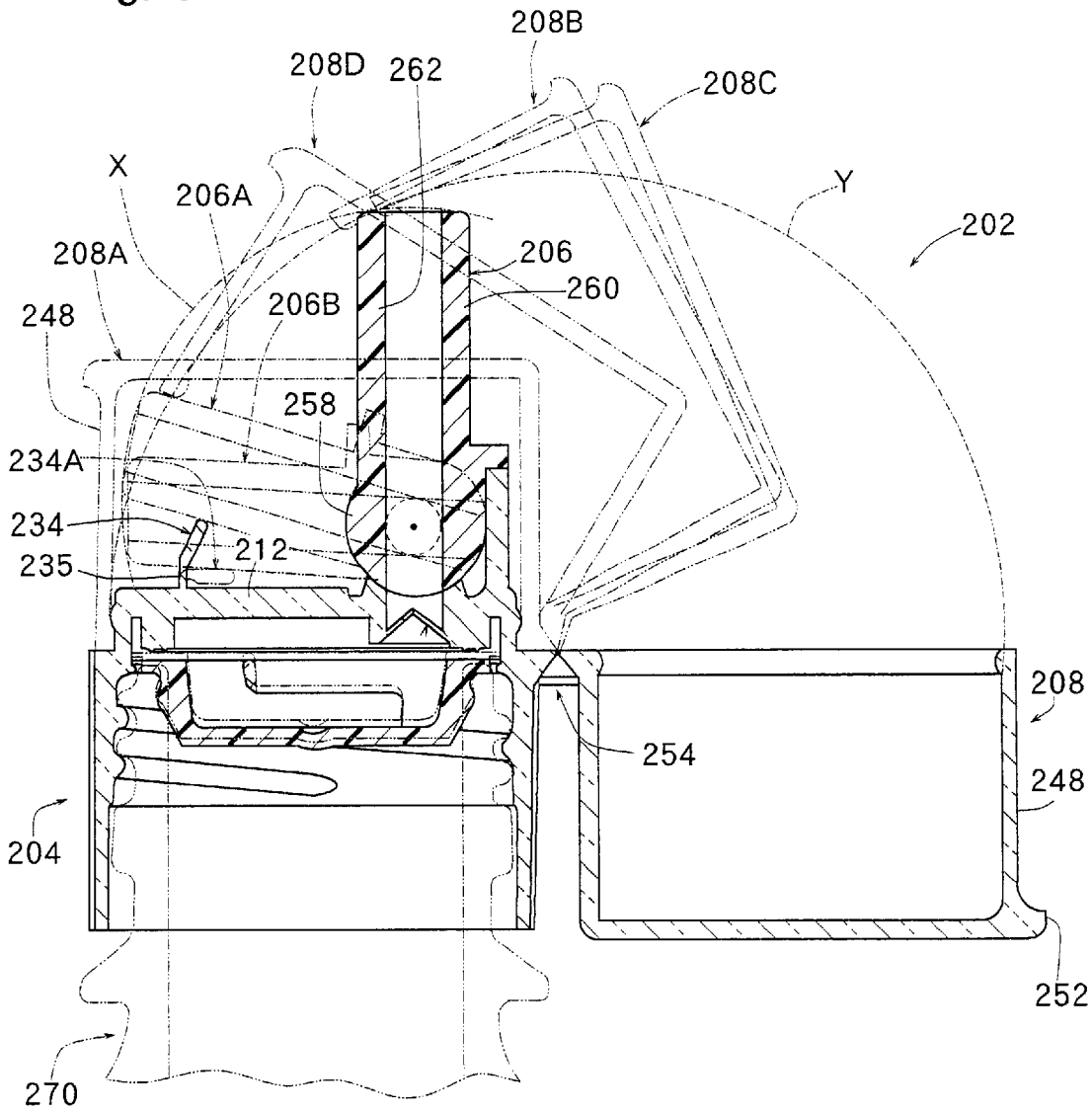
FIG. 9 is a vertical sectional view of the container closure shown in FIG. 8.
Figure 10:
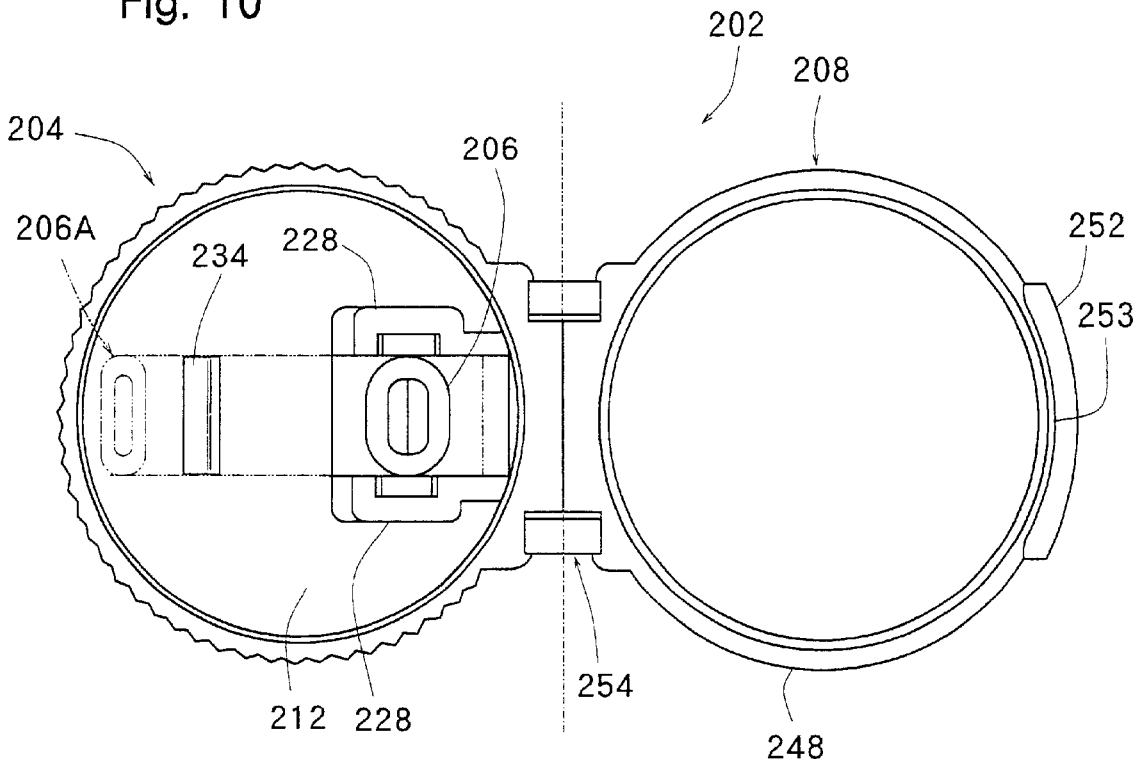
FIG. 10 is a plan view of the container closure shown in FIG. 8.
Figure 11:
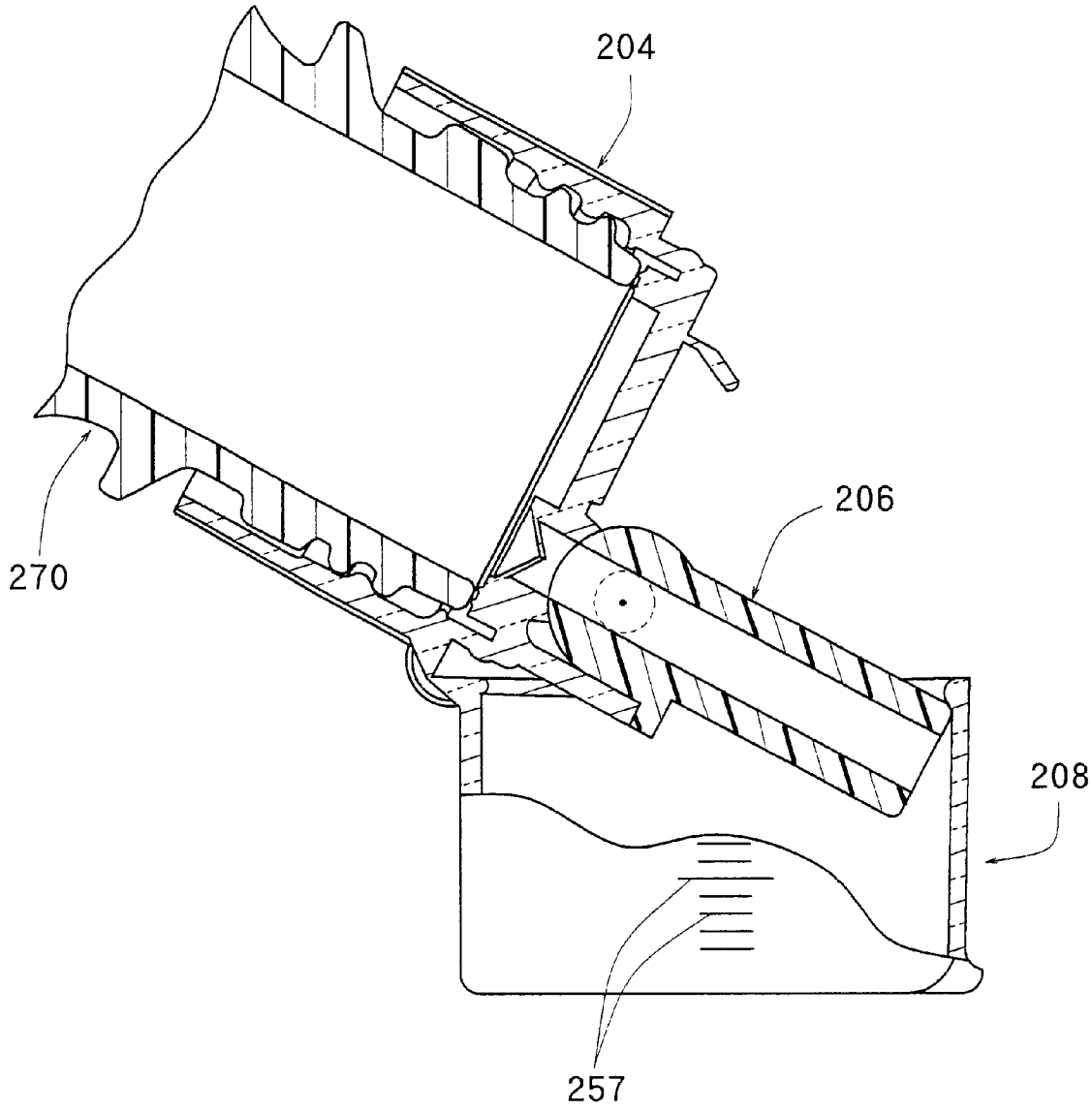
FIG. 11 is a vertical sectional view similar to FIG. 9 for illustrating a manner in which an outer cap in the container closure shown in FIG. 8 is used as a measuring cup.

With reference to FIG. 8, a metering mark 257 is formed on the outer peripheral surface of the skirt wall 248 in the outer cap 208. The metering mark 257 may, for example, be a plurality of ridges extending circumferentially with required spacing in the axial direction. If desired, the metering mark 257 may be formed on an inner peripheral surface of the skirt wall 248. As will be further mentioned later on, if a liquid (e.g., a cleaning fluid) accommodated in the container is discharged while being metered, the liquid can once be discharged into the outer cap 208, and measured by reference to the metering mark 257. To enable easy recognition of the relationship between the amount of the liquid discharged into the outer cap 208 and the metering mark 257, the outer cap 208 molded integrally with the closure body 204 is preferably transparent or semitransparent. If the outer cap 208 molded integrally with the closure body 204 is opaque, the metering mark 257 should desirably be formed on the inner peripheral surface of the skirt wall 248 so that the relationship between the amount of the liquid discharged into the outer cap 208 and the metering mark 257 can be recognized. The outer cap 208 in the embodiment shown in FIGS. 8 to 11 is substantially the same as the outer cap 8 in the embodiment shown in FIGS. 1 to 6, except for the above-described constitution.

As will be clearly understood by reference to FIGS. 8 to 11, an extension 260 of an outflow tube 206 in the embodiment shown in FIGS. 8 to 11 is in a nearly elliptic cylindrical shape extending substantially perpendicularly to a base 258 of a nearly cylindrical shape. The cross sectional shape of a penetrating outflow path 262 formed in the outflow tube 206 is nearly elliptical. The outflow tube 206 in the embodiment shown in FIGS. 8 to 11 is substantially the same as the outflow tube 6 in the embodiment shown in FIGS. 1 to 6, except for the above-described constitution.

In the embodiment shown in FIGS. 8 to 11, the following facts should be noticed: Assume that the outflow tube 206 is pivoted independently and accidentally to a closed position shown by two-dot chain lines 206A in FIG. 9 when the outer cap 208 lies at an open position shown by solid lines in FIG. 9. In this case, when the outer cap 208 is pivotally moved from the open position toward the closed position, it is contacted with the outflow tube 206 only when pivoted to a position shown by two-dot chain lines 208D in FIG. 9. As will be clearly seen by comparison between a locus X of the outflow tube 206 and a locus Y of the outer cap 208, the amount of mutual interference between the skirt wall 248 of the outer cap 208 and the outflow tube 206 is considerably large, when the outflow tube 206 lies at the position indicated by the two-dot chain lines 206A and the outer cap 208 is located at the position indicated by the two-dot chain lines 208D. Thus, if the outflow tube 206 cannot be further pivotally moved counterclockwise in FIG. 9 from the position indicated by the two-dot chain lines 206A, it is impossible to bring the outflow tube 206 into the outer cap 208 and pivot the outer cap 208 to the closed position, unless a considerably great force is exerted on the outer cap 208 to deform the outer cap 208 and/or the outflow tube 206 elastically. In this case, pivoting of the outer cap 208 is considerably difficult, although not impossible. In the illustrated container closure constituted in accordance with the invention, as stated earlier, the closed position restricting piece 234 for restricting the outflow tube 206 to the closed position 206A extends slantwise upwardly in a predetermined direction. When a force of a predetermined value or more is applied to its upper edge, the closed position restricting piece 234 is tilted about the thin-walled lower end portion 235, as shown by two-dot chain lines 234A in FIG. 9. Thus, the outflow tube 206 is pivoted counterclockwise in FIG. 9 beyond the closed position 206A to a position shown by two-dot chain lines 206B. As a result, the amount of mutual interference between the skirt wall 248 of the outer cap 208 and the outflow tube 206 is decreased or eliminated. Hence, even if the outflow tube 206 is pivoted independently and accidentally to the closed position shown by the two-dot chain lines 206A in FIG. 9, the outer cap 208 can be pivoted sufficiently easily to the closed position shown by the two-dot chain lines 208A in FIG. 9. When the outer cap 208 is pivoted to the closed position, the outer cap 208 is separated from the outflow tube 206. Thus, the closed position restricting piece 234 is elastically restored to the original state, and the outflow tube 206 is returned to the closed position shown by the two-dot chain lines 206A in FIG. 9.

In connection with the embodiment shown in FIGS. 8 to 11, it should also be noticed that the pivotal movement of the outer cap 208 for opening or closing can be performed, with a finger being hooked on the grip protrusion 252 disposed in the upper end portion of the outer peripheral surface of the skirt wall 248. In the embodiment shown in FIGS. 1 to 6, the grip protrusion 52 is formed in the lower end portion of the outer peripheral surface of the skirt wall 48. In this case, when the outer cap 8 is removed from the outflow tube 6 or when the outer cap 8 is contacted with the outflow tube 6, the finger hooked on the grip protrusion 52 is likely to touch the front end of the outflow tube 6 from which the liquid contained in the container 70 is to be flowed out. On the other hand, if the grip protrusion 252 is formed in the upper end portion of the outer peripheral surface of the skirt wall 248, the finger hooked on the grip protrusion 252 is unlikely to touch the front end of the outflow tube 206.

In the embodiment shown in FIGS. 8 to 11, furthermore, if the liquid accommodated in the container 270 is a cleaning fluid or the like, and should desirably be discharged in a required weighed amount, the following procedure can be performed with the use of the outer cap 208 as a measuring cup: First, the outer cap 208 is pivoted from the closed position shown by the two-dot chain lines 208A in FIG. 9 to the position shown by the two-dot chain lines 208B in FIG. 9, and the outflow tube 206 is brought to the outflow position. Then, the container 270 itself is tilted to bring the container 270 and the container closure 202 into the state shown in FIG. 11. Then, the main portion of the container 270, for example, is crushed to discharge the liquid from the container 270 into the outer cap 208. On this occasion, the amount of discharge is measured by reference to the metering mark 257 disposed on the outer cap 208. After a required amount of the liquid is discharged, the outer cap 208 itself is maintained in the state shown in FIG. 11, for example. The container 270, and the closure body 204 and the outflow tube 206 in the container closure 202 are pivoted counterclockwise in FIG. 11 to remove the outflow tube 206 from the outer cap 208. Then, the outer cap 208 is suitably tilted to discharge the liquid present in the outer cap 208 to a required place.

What we claim is:

1. A container closure, comprising:

a closure body adapted to be mounted on a mouth-and-neck portion of a container;

an outflow tube having a penetrating outflow path; and an outer cap, and wherein:

the closure body has a main wall covering a top surface of the mouth-and-neck portion of the container when the closure body is mounted on the mouth-and-neck portion of the container, and an outflow hole is disposed in the main wall;

the outflow tube is pivotably mounted on an upper surface of the main wall of the closure body, when the closure body is mounted on the mouth-and-neck portion of the container and the outflow tube is located at an outflow position at which the outflow tube extends upward from the outflow hole of the main wall, the penetrating outflow path communicates with the interior of the container via the outflow hole; and when the outflow tube is toppled to a closed position, the penetrating outflow path is cut off from communication with the outflow hole;

the outer cap is mounted on the closure body pivotably between a closed position and an open position; when at the closed position, the outer cap covers the main wall of the closure body and the outflow tube; and when at the open position, the outer cap exposes the main wall of the closure body and the outflow tube;

when the outer cap is pivoted from the closed position toward the open position, the outer cap contacts the outflow tube located at the closed position to erect the outflow tube from the closed position to the outflow position, and when the outer cap is then further pivoted toward the open position the outer cap is separated from the outflow tube and brought to the open position;

when the outer cap is pivoted from the open position toward the closed position, the outer cap contacts the outflow tube located at the outflow position to topple the outflow tube from the outflow position to the closed position, and the outer cap is also brought to the closed position;

a closed position restricting piece is disposed on the main wall of the closure body;

when a pressing force of at least a predetermined value is exerted on the closed position restricting piece via the outflow tube as the outflow tube is toppled and contacted with the closed position restricting piece, the closed position restricting piece is tilted and the outflow tube is further toppled; and when the pressing force via the outflow tube is released from the closed position restricting piece, the closed position restricting piece is elastically restored.

2. The container closure of claim 1 wherein:

the closed position restricting piece has a thin-walled lower end portion, and is tilted by being pivoted about the thin-walled lower end portion as a pivot center.

3. The container closure of claim 1, wherein:

a pivot center axis of the outflow tube and a pivot center axis of the outer cap extend substantially parallel, and the pivot center axis of the outer cap is positioned below, and radially outwardly of, the pivot center axis of the outflow tube.

4. A container closure, comprising:

a closure body adapted to be mounted on a mouth-and-neck portion of a container;

an outflow tube having a penetrating outflow path; and an outer cap, and wherein:

the closure body has a main wall covering a top surface of the mouth-and-neck portion of the container when the closure body is mounted on the mouth-and-neck portion of the container, and an outflow hole is disposed in the main wall;

the outflow tube is pivotably mounted on an upper surface of the main wall of the closure body; when the closure body is mounted on the mouth-and-neck portion of the container and the outflow tube is located at an outflow position at which the outflow tube extends upward from the outflow hole of the main wall, the penetrating outflow path communicates with an interior of the container via the outflow hole; and when the outflow tube is toppled to a closed position, the penetrating outflow path is cut off from communication with the outflow hole;

the outer cap is mounted on the closure body pivotably between a closed position and an open position; when at the closed position, the outer cap covers the main wall of the closure body and the outflow tube; and when at the open position, the outer cap exposes the main wall of the closure body and the outflow tube;

when the outer cap is pivoted from the closed position toward the open position, the outer cap contacts the outflow tube located at the closed position to erect the outflow tube from the closed position to the outflow position, and when the outer cap is then further pivoted toward the open position the outer cap is separated from the outflow tube and brought to the open position;

when the outer cap is pivoted from the open position toward the closed position, the outer cap contacts the outflow tube located at the outflow position to topple the outflow tube from the outflow position to the closed position, and the outer cap is also brought to the closed position;

the outer cap has a circular top panel wall, and a cylindrical skirt wall extending downwardly from a peripheral edge of the top panel wall;

when the outer cap is pivoted from the closed position toward the open position, an inner peripheral surface of a lower end portion of the skirt wall contacts a front end portion of the outflow tube; and when the outer cap is pivoted from the open position toward the closed position, a lower end or the inner peripheral surface of the lower end portion of the skirt wall contacts the front end portion of the outflow tube.

5. The container closure of claim 4, wherein:

a grip protrusion protruding radially outwardly is disposed at a position in an upper end portion of an outer peripheral surface of the skirt wall of the outer cap, the position being farthermost from a pivot center axis of the outer cap.

6. The container closure of claim 1, wherein:

a metering mark is disposed on the outer cap.

7. The container closure of claim 6, wherein:

the outer cap is transparent or semitransparent.

8. The container closure of claim 4, wherein:

a pivot center axis of the outflow tube and a pivot center axis of the outer cap extend substantially parallel, and the pivot center axis of the outer cap is positioned below, and radially outwardly of, the pivot center axis of the outflow tube.

9. The container closure of claim 4, wherein:

a metering mark is disposed on the outer cap.

10. The container closure of claim 9, wherein:

the outer cap is transparent or semitransparent.

* * * * *